US007204401B2

(12) United States Patent
Suzuki et al.

(10) Patent No.: US 7,204,401 B2
(45) Date of Patent: Apr. 17, 2007

(54) WEB MATERIAL FEEDING APPARATUS

(75) Inventors: Hisao Suzuki, Tokyo (JP); Syozo Horikawa, Tokyo (JP); Hiroshi Okamoto, Tokyo (JP); Takayuki Irikura, Kohriyama (JP); Hiroyuki Yoshinari, Kohriyama (JP)

(73) Assignee: Japan Tobacco Inc., Tokyo (JP)

( * ) Notice: Subject to any disclaimer, the term of this patent is extended or adjusted under 35 U.S.C. 154(b) by 41 days.

(21) Appl. No.: 10/727,502

(22) Filed: Dec. 5, 2003

(65) Prior Publication Data

US 2004/0108351 A1 Jun. 10, 2004

Related U.S. Application Data

(63) Continuation of application No. PCT/JP02/05708, filed on Jun. 7, 2002.

(30) Foreign Application Priority Data

Jun. 8, 2001 (JP) ..... 2001-174153

(51) Int. Cl.
*B65H 23/032* (2006.01)
*B65H 23/24* (2006.01)

(52) U.S. Cl. ..... 226/19; 242/419.3; 242/615.3

(58) Field of Classification Search ..... 226/3, 226/19, 20, 39, 45, 195, 196.1; 242/419.3, 242/615.3

See application file for complete search history.

(56) References Cited

U.S. PATENT DOCUMENTS 3,123,268 A * 3/1964 Gagg ..... 226/111
3,559,859 A * 2/1971 McArthur ..... 226/19
3,679,112 A * 7/1972 Black et al. ..... 226/3
4,369,905 A * 1/1983 Tokuno ..... 226/17
4,824,001 A * 4/1989 Mick et al. ..... 226/3
5,806,746 A * 9/1998 Holbrook et al. ..... 226/95

FOREIGN PATENT DOCUMENTS

| | | |
|---|---|---|
| EP | 0 723 925 A2 | 7/1996 |
| JP | 61-108198 U | 7/1986 |
| JP | 7-125895 A | 5/1995 |
| JP | 2000-185854 A | 7/2000 |

* cited by examiner

*Primary Examiner*—William A. Rivera
*Assistant Examiner*—Scott Haugland
(74) *Attorney, Agent, or Firm*—Birch, Stewart, Kolasch & Birch LLP

(57) ABSTRACT

A web material feeding apparatus has a suction plate 24 provided near an outlet of a reservoir box 2. The suction plate 24 can be shifted in the direction across a feeding path for tip paper C, by operation of a motor 76. The feeding apparatus also has a sensor unit 96 provided at the upstream side of a receiving drum 12. The sensor unit 96 supplies a detection signal to a controller 120. When the controller 120 detects meandering of the tip paper C on the basis of the detection signal supplied from the sensor unit 96, the controller 120 actuates the motor 76 to shift the suction plate 24 to thereby correct the meandering of the tip paper C.

6 Claims, 7 Drawing Sheets

WEB MATERIAL FEEDING APPARATUS

This application is a Continuation of copending PCT International Application No. PCT/JP02/05708 filed on Jun. 7, 2002, which designated the United States, and on which priority is claimed under 35 U.S.C. § 120, and this Non-provisional application claims priority under 35 U.S.C. § 119 (a) on Patent Application No(s). 2001-174153 filed in Japan on Jun. 8, 2001, the entire contents of which are hereby incorporated by reference.

TECHNICAL FIELD

The invention relates to a feeding apparatus for feeding a web material along a predetermined feeding path, particularly to a web material feeding apparatus which can correct meandering of a web material produced while the web material is being fed.

BACKGROUND ART

Feeding apparatuses of this type are used, for example, for feeding paper to a cigarette manufacturing machine, feeding tip paper to a filter cigarette manufacturing machine, and feeding paper to a filter-rod manufacturing machine. In an example of a tip paper feeding apparatus, the feeding apparatus has a reservoir box provided on a tip paper feeding path. Tip-paper drawn out from a roll is fed through the reservoir box to a tip paper winding section. When the roll in use comes close to an end, the feeding apparatus draws out the tip paper at a speed higher than a normal speed and stores a predetermined length of the tip paper in the reservoir box. Then, the feeding apparatus stops drawing out the tip paper from the roll, and makes preparations for connecting a new roll while the tip paper is fed from the reservoir box. After finishing the preparations, the feeding apparatus starts drawing out the tip paper from the new roll in a normal manner.

When a web material such as tip paper is made to travel lengthwise as in the above-described manner, the web material tends to oscillate widthwise while it is traveling. This phenomenon is called meandering. When such meandering happens, the tip paper is winded deviating from its intended position, in the winding section. If the deviation is very large, it produces defective filter cigarettes.

In the technical fields which handle the feeding of thick web made of industrial materials such as steel products, there is known a conventional technique in which when a web material meanders, the web material is pushed widthwise to correct the meandering thereof. Specifically, one of the side edges of a traveling web material is pushed widthwise to thereby shift the entire web material widthwise. The introduction of a meandering correction technique like this into an apparatus for feeding tip paper or the like is desired. As a mechanical property, thin paper materials such as tip paper have enough strength against pulling force. However, their strength against pushing force is far lower than their strength against pulling force. Hence, it is difficult to shift the entire tip paper successfully by pushing a side edge of the traveling tip paper widthwise. Also, there is a concern that the pushing force will be concentrated on the side edge and damage the traveling tip paper.

Thus, in the technical field which handles an apparatus for feeding a highly flexible web material such as thin paper or a film, a technique suited to the characteristics of this type of web material needs to be introduced to correct the meandering of the web material. This is a purpose to be achieved.

DISCLOSURE OF THE INVENTION

A web material feeding apparatus according to the invention shifts a suction plate in the direction across a feeding path for a web material so that obviate deviation of the web material widthwise, or correct the meandering of thereof when the deviation of the web material or the meandering thereof on the feeding path is detected. For this purpose, the feeding apparatus comprises a feeding path along which a web material extending from a roll is guided lengthwise; a feeding roller for drawing out the web material along the feeding path; a suction plate provided on the feeding path, for sucking and thereby exerting braking force on the web material which is drawn out and traveling; a meandering detection means provided at a downstream side of the suction plate on the feeding path, for detecting deviation of the web material in the width direction thereof; and a meandering correction means for correcting the deviation of the web material by shifting the suction plate in a direction across the feeding path, when the deviation is detected by the meandering detection means.

In this feeding apparatus, as the suction plate is shifted, the web material is shifted widthwise. Normally, the suction plate sucks a surface of the web material to thereby exert frictional resistance on the sucked surface. In this way, the suction plate exerts braking force on the traveling web material. This braking force gives a moderate tension to a downstream portion of the web material which travels the downstream side of the suction plate on the feeding path. Hence, when the suction plate shifts with the suction surface thereof being in face contact with the web material, the suction plate can shift the web material widthwise, exerting face pressure on that part of the web material which is in face contact with the suction surface. Thus, when a meandering of the web material is corrected, excessively large force being concentrated on a side edge of the web material is avoided.

As seen from the above, the web material feeding apparatus according to the invention can correct the meandering of the traveling web material without damaging the web material. Hence, the web material feeding apparatus according to the invention can meet a demand for increasing the speed of feeding the web material. Also, the feeding apparatus can effectively reduce the rejection rate regarding what are manufactured using a web material, such as cigarettes, filter cigarettes and filter rods.

The feeding apparatus according to the invention may also have a reservoir box provided on the feeding path, for storing the web material drawn out from the roll, where the suction plate is provided near an outlet of the reservoir box. In this case, the web material once gets a free state inside the reservoir box. Hence, when the suction plate is shifted in the direction across the feeding path, excessively large force is not exerted on the web material. Further, when the reservoir box is provided, the suction plate can exert braking force on the web material more effectively, and correct the meandering of the web material more reliably.

The feeding apparatus according to the invention may also have two guide members provided near the outlet of the reservoir box on the opposite sides of the feeding path, for guiding the opposite side-edges of the web material, where the meandering correction means is adapted to shift the two guide members together with the suction plate. In this case, normally, the two guide members guide the opposite side-edges of the web material, and determine the position of the web material drawn-out from the reservoir box with respect to the width direction of the web material. When a meandering of the web material is corrected, the two guide members cooperate with the suction plate to shift the web material widthwise. Also, the guide members can determine the position of the web material, at the outlet of the reservoir box, and prevent the web material from deviating from the suction plate.

It is desirable that the suction plate extends from the outlet of the reservoir box in the direction in which the web material is drawn out, and that the two guide members are arranged on the opposite sides of the suction plate. As mentioned above, the suction plate sucks the web material with a suction surface thereof. The face pressure which the suction plate exerts acts not only as braking force on the traveling web material, but also as force which holds the traveling web material widthwise. Hence, when the guide members are arranged on the opposite sides of the suction plate, the guiding of the web material by the guide members and the holding of the web material by the suction plate are attained at the same position on the feeding path. When the suction plate is arranged to extend in the direction in which the web material is drawn out, the web material does not deviate from the suction plate to a large degree even if the web material meanders.

BRIEF DESCRIPTION OF THE DRAWINGS

FIG. 4 is considered as a front view.

BEST MODE OF CARRYING OUT THE INVENTION

Figure 1:
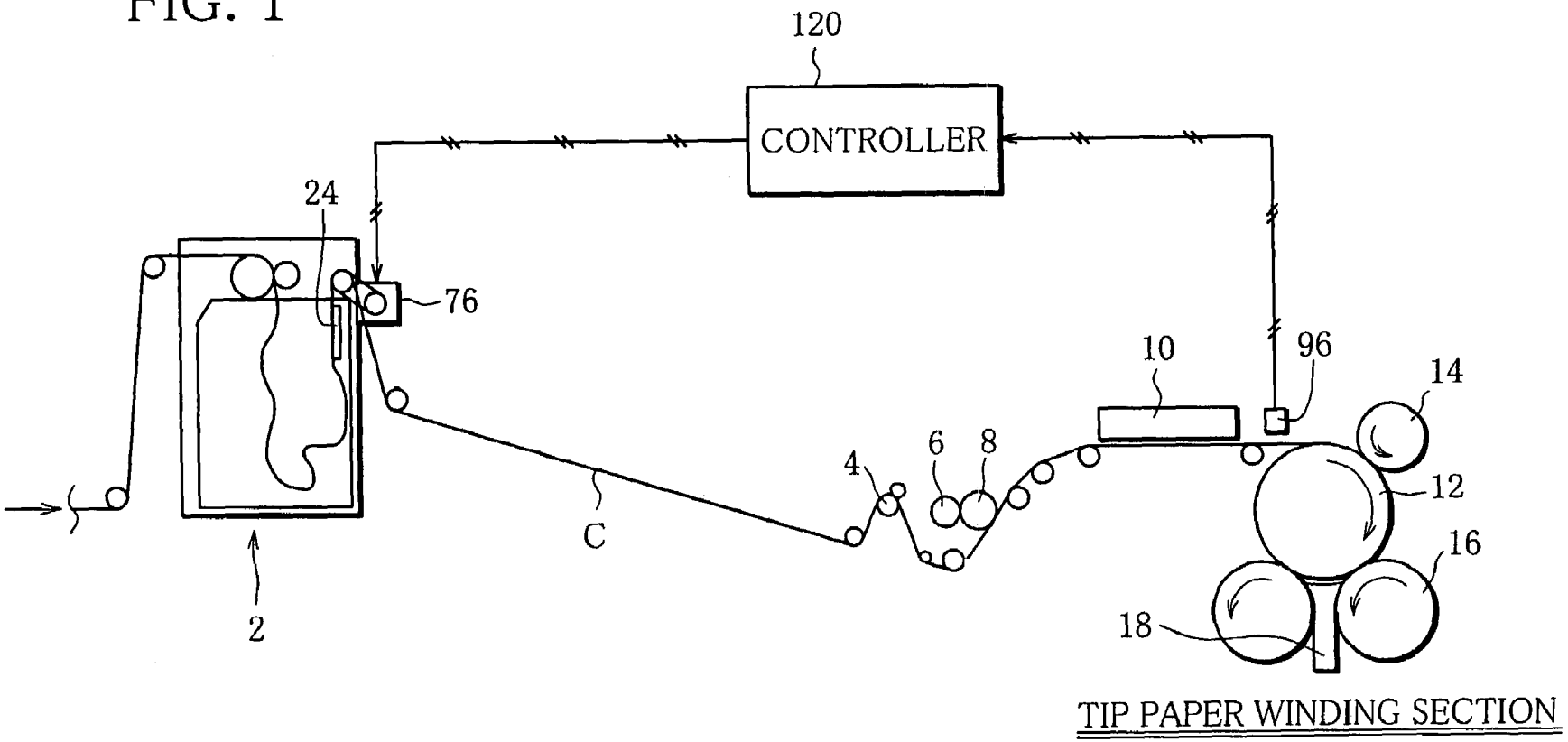
FIG. 1 is an illustration schematically showing an embodiment of a web material feeding apparatus.

FIG. 1 schematically shows, as an embodiment of the invention, a tip paper feeding apparatus applied to, for example, a filter attachment machine. The filter attachment machine receives cigarettes from a cigarette manufacturing machine (not shown) and forms filter cigarettes by connecting a filter plug with the cigarettes. The connecting of a filter plug with cigarettes is performed in a tip paper winding section of the filter attachment machine. Hence, the tip paper feeding apparatus has a feeding path running from a roll (not shown) to the tip paper winding section.

Many guide rollers are arranged on the feeding path, and tip paper C is guided by the guide rollers to the tip paper winding section. A reservoir box 2 is provided on the feeding path. The tip paper C drawn out from the roll once gets a free state and is stored in the reservoir box 2. The downstream side of the reservoir box 2 is provided a feeding roller 4, and the tip paper C is drawn out from the reservoir box 2 by the feeding roller 4.

The upstream side of the feeding roller 4, glue is applied to one side of the tip paper C by a gluing unit. Specifically, the gluing unit has a glue roller 6, and tip glue is fed to the glue roller 6. A transfer roller 8 rotates in contact with the glue roller 6, and the tip glue is transferred from the glue roller 6 onto the outer surface of the transfer roller 8 to form a layer of a predetermined thickness. When the tip paper C passes the gluing unit, the glue is spread on that surface of the tip paper which comes in contact with the transfer roller 6, in a predetermined pattern.

Then, the tip paper C is heated by a post heater 10 so that the tip glue containing water will be dried preliminarily, and then fed to a receiving drum 12. The receiving drum 12 is provided in the winding section, and receives the tip paper C by sucking the tip paper C onto the circumferential surface thereof. A bladed drum 14 is provided adjacent to the receiving drum 12. As the bladed drum 14 rotates, the tip paper C is cut into tip paper pieces of a predetermined length.

Since the process of winding a tip paper piece in the filter attachment machine is known to the public, it will be explained below without a specific illustration. Cigarettes and a filter plug, around which a tip paper piece should be winded, are supplied by a double enclosure drum 16 of the filter attachment machine. Here, on the double enclosure drum 16 semi-finished products are conveyed. The semi-finished products consists of two cigarettes and a filter plug, where the two cigarette are arranged at the opposite ends of the filter plug. The tip paper piece is fed from the receiving drum 12 to stick to the outer surface of the semi-finished product and connect the cigarettes and filter plug of the product.

Under the receiving drum 12 and the downstream side of the double enclosure drum 16 is provided a rolling plate 18. Between the rolling plate 18 and the circumferential surface of the receiving drum 12 is formed a rolling passage for the semi-finished products. When fed into the rolling passage, the semi-finished product rolls, being guided by the rolling plate 18. While the semi-finished product is rolling, the tip paper piece is winded around the product. By being winded with the tip paper piece, the semi-finished product becomes a finished double filter cigarette, where the two cigarettes are connected to the filter plug at the opposite ends thereof.

Figure 2:
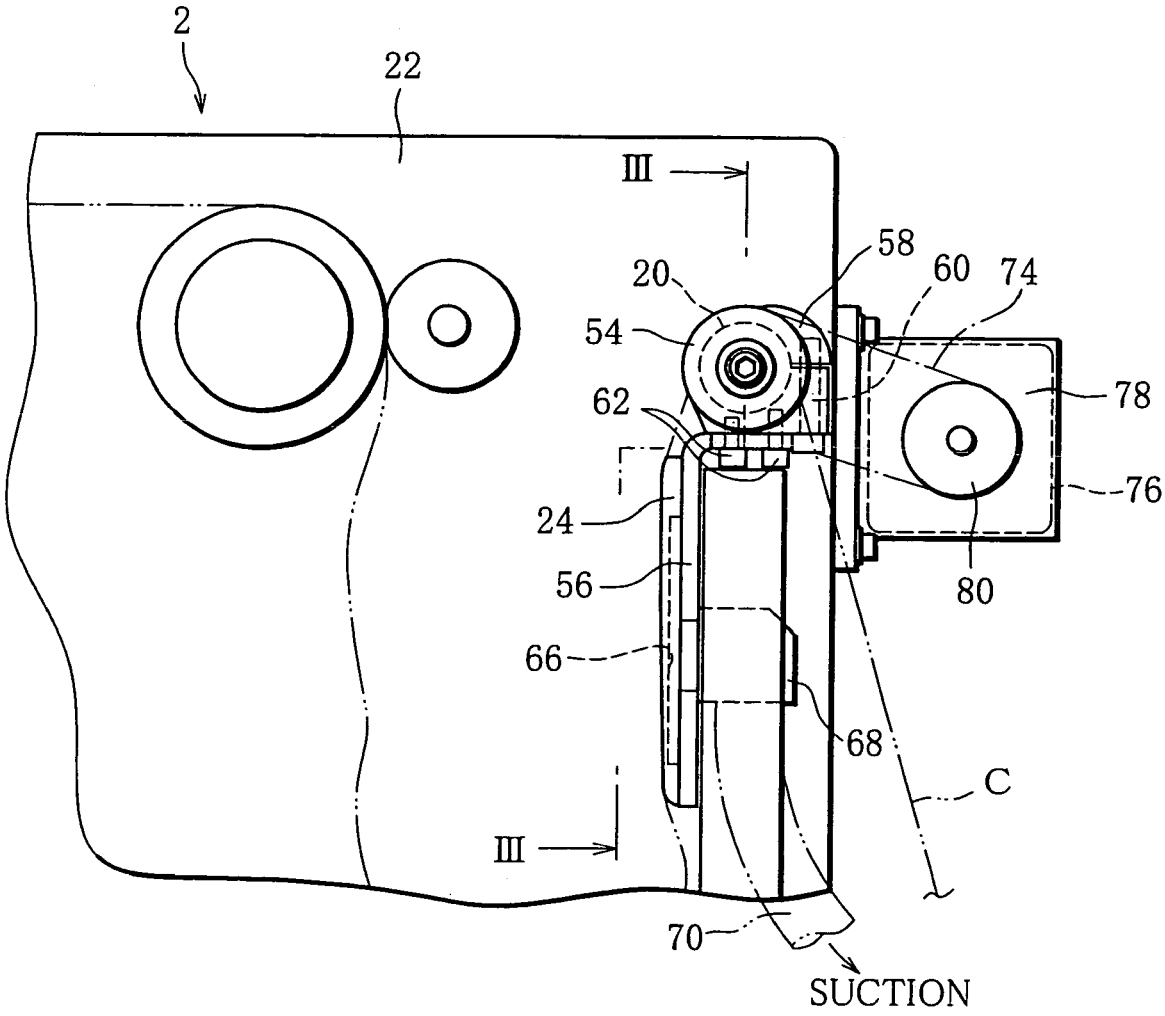
FIG. 2 is a front view specifically showing how a suction plate is fitted to a reservoir box.

FIG. 2 specifically shows an outlet of the reservoir box 2 and the vicinity of the outlet. At the outlet of the reservoir box 2 is provided a tube-like guide sleeve 20. The guide sleeve 20 extends horizontally from a back wall 22 of the reservoir box 2 toward the front of the machine. At the outlet, the guide sleeve 20 guides the tip paper C to be drawn out from the reservoir box 2, while a suction plate 24 exerts braking force on the tip paper C, at an upstream side of the guide sleeve 20. The suction plate 24 is provided inside the reservoir box 2 and extends from the guide sleeve 20 downward. The tip paper C is drawn upward from the bottom of the reservoir box 2, along a suction surface of the suction plate 24, and turned around the guide sleeve 20.

Figure 3:
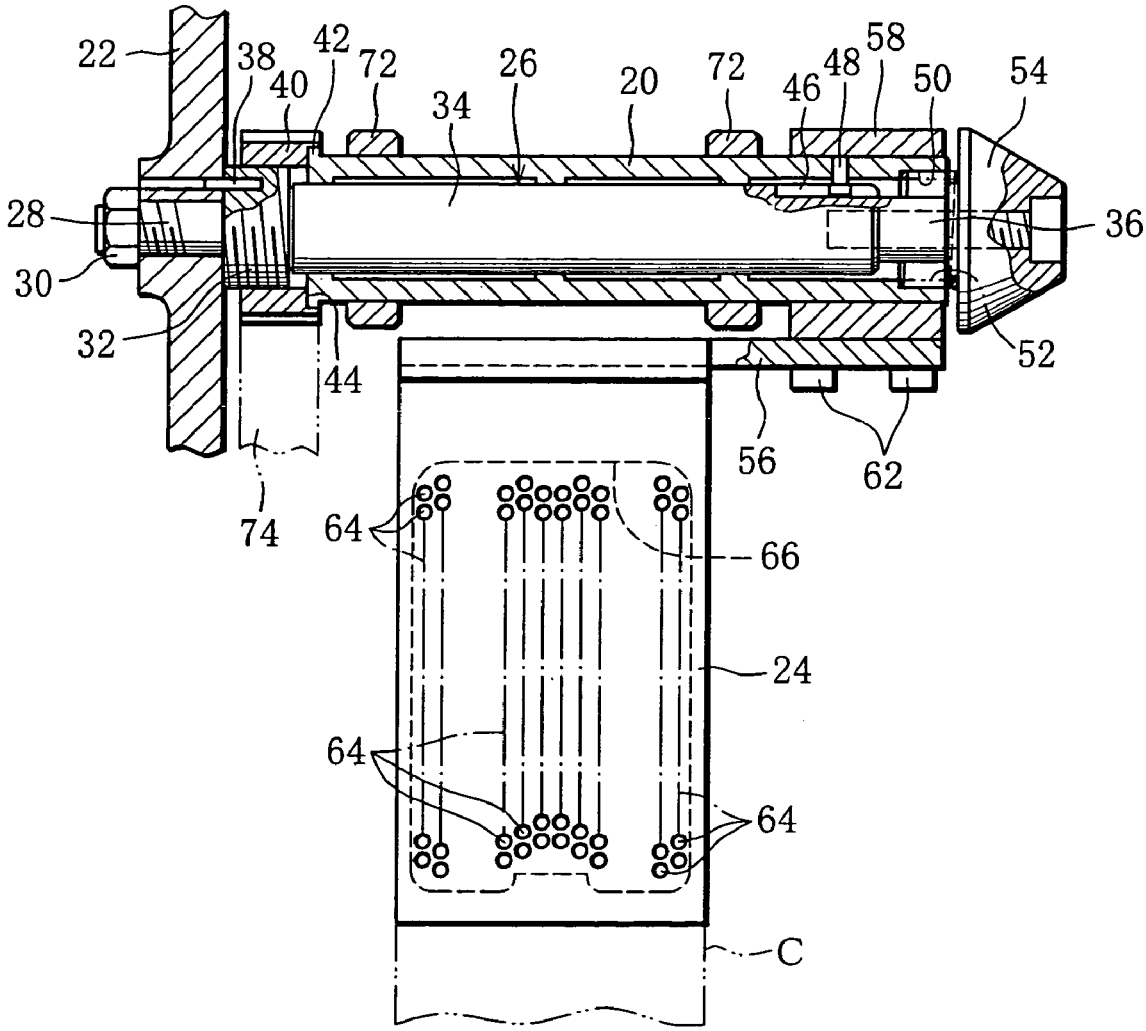
FIG. 3 is a cross-sectional view taken along line III—III of FIG. 2.

FIG. 3 specifically shows how the guide sleeve 20 and the suction plate 24 are fitted. A guide shaft 26 is fitted to the back wall 22 of the reservoir box 2, and the guide sleeve 20 is mounted on the guide shaft 26 and thus supported by the guide shaft 26. The guide shaft 26 has a threaded part 28 at the proximal end thereof. The guide shaft 26 is fixed by passing the threaded part 28 through the back wall 22 and fastening a nut 30 onto the threaded part 28. The guide shaft 26 extends from its one end toward the front of the machine, and has a stepped shape. Specifically, the threaded part 28 is followed by a feed screw 32 which is largest in diameter. The feed screw 32 is in close contact with the back wall 22. A column-shaped shaft body 34 extends from the feed screw 32 through a groove. The shaft body 34 is smaller in diameter than the feed screw 32. The shaft body 34 is followed by a distal end part 36. The distal end part 36 is smallest in diameter. A pin 38 is pressed through the back wall 22 into the feed screw 32, in the axial direction. The rear end of the pin is located in the back wall 22. Thus, the guide shaft 26 is restrained from rotating around its axis relative to the back wall 22.

The feed screw 32 is meshed with a gear pulley 40. Corresponding to the feed screw 32, the gear pulley 40 has an internal thread at the inner circumferential surface thereof. The gear pulley 40 can rotate relative to the feed screw 32 and shift in the axial direction, corresponding to the angle of rotation thereof.

The guide sleeve 20 is mounted on the shaft body 34. In this state, the guide sleeve 20 can slide in the axial direction. The guide sleeve 20 has a flange 42 at one end thereof, while the gear pulley 40 has a thrust bearing surface 44 formed to face the flange 42. The gear pulley 40 is adapted to receive the flange 42 of the guide sleeve 20 on the thrust bearing surface 44 to thereby support the guide sleeve 20 in the axial direction.

The shaft body 34 has a key groove 46 formed to extend from the boundary between the shaft body 34 and the distal end part 36. A pin 48 is pressed into the guide sleeve 20 and projects inside the guide sleeve 20. The head of the pin 48 fits in the key groove 46. By this, the guide sleeve 20 is restrained from rotating around its axis relative to the guide shaft 26.

A distal end of the guide sleeve 20 has a larger diameter bore 50 than the rest thereof, so that the guide sleeve 20 has a step inside. A coil spring 52 is fitted in the bore 50. A roller cap 54 in the shape of a truncated cone is fitted to the distal end part 36 of the guide shaft 26. The roller cap 54 is bolted to the guide shaft 26. The roller cap 54 covers a distal end opening of the guide sleeve 20 and thereby presses an end of the coil spring 52. The coil spring 52 is compressed between the roller cap 54 and the step of the bore 50 and thereby given a pre-load. Hence, the guide sleeve 20 is pushed toward the back of the machine by the urging force of the coil spring 52, and pressed on the gear pulley 42 through the flange 42 thereof.

The suction plate 24 is fitted to the guide sleeve 20 using a bracket 56. A clamping holder 28 is mounted on the guide sleeve 20. As shown in FIG. 2, the clamping holder 58 is fastened to the guide sleeve 20 by clamp bolts 60. The bracket 56 is placed against the undersurface of the clamping holder 58, and fastened to the clamping holder 58 by bolts 62. The bracket 56 is an angle bracket. The part of the bracket 56 which corresponds to the short side of thereof extends from the undersurface of the clamping holder 58, along the guide sleeve 20, toward the back of the machine. The part of the bracket 56 which corresponds to the long side thereof hangs, or extends downward, along the feeding path for the tip paper C.

As shown in FIG. 3, the suction plate 24 has many suction holes 64 formed on the suction surface thereof. The suction holes 64 are arranged at predetermined pitches in the direction in which the tip paper C is drawn out. In FIG. 3, rows of suction holes 64 are represented by dashed lines. As shown in FIG. 2, a suction chamber 66 is defined between the suction plate 24 and the bracket 56, and the individual suction holes 64 open into the suction chamber 66. A suction hose 70 is connected to the suction chamber 66 using an elbow 68. Air in the suction chamber 66 is sucked through the suction hose 70.

The width of the suction plate 24 is, for example, a little broader than that of the tip paper C. Two guide rings 72 are fitted to the guide sleeve 20 with a distance equal to the width of the suction plate 24 between them. The two guide rings 72 are arranged on the opposite sides of the feeding path for the tip paper C to guide the side edges of the tip paper C therebetween. In the case shown in FIG. 2, the width of the suction plate 24 does not absolutely need to be broader than that of the tip paper C.

As mentioned above, the guide sleeve 20 can slide on the shaft body 34 of the guide shaft 26. As the gear pulley 40 rotates, the position of the gear pulley 40 relative to the feed screw 32 changes. A gear belt 74 is passed around the gear pulley 40. When the gear pulley 40 is driven by means of the gear belt 74, the guide sleeve 20 shifts in the axial direction because of the shift of the gear pulley 40.

Specifically, as shown in FIG. 2, a motor 76 is fitted to the reservoir box 2 using a bracket 78. A driving pulley 80 is fitted on an output shaft of the motor 76. The gear belt 74 is passed around the driving pulley 80 and the gear pulley 40.

The motor 76 is, for example, a stepping motor, which can control the angle of rotation transmitted to the gear pulley 40, in the opposite directions, by the step. The angle of rotation of the gear pulley 40 is converted to the axial feed, depending on the pitch of the feed screw 32, and the guide sleeve 20 is shifted in the axial direction corresponding to this axial feed. As already mentioned, the guide sleeve 20 is pushed toward the back of the machine by the urging force of the coil spring 52, however, this axial shift is restricted by the gear pulley 40. Thus, when the gear pulley 40 shifts away from the back wall 22, the guide sleeve 20 shifts toward the front of the machine, against the urging force of the coil spring 52, and compresses the coil spring 52 further. In contrast, when the gear pulley 40 shifts toward the back wall 22, the guide sleeve 20 is pushed by the urging force of the coil spring 52 and shifts toward the back of the machine following the shift of the gear pulley 40. As the guide sleeve 20 shifts in the axial direction. This way, the suction plate 24 and the guide rings 72 shift in the direction across the feeding path.

Figure 4:
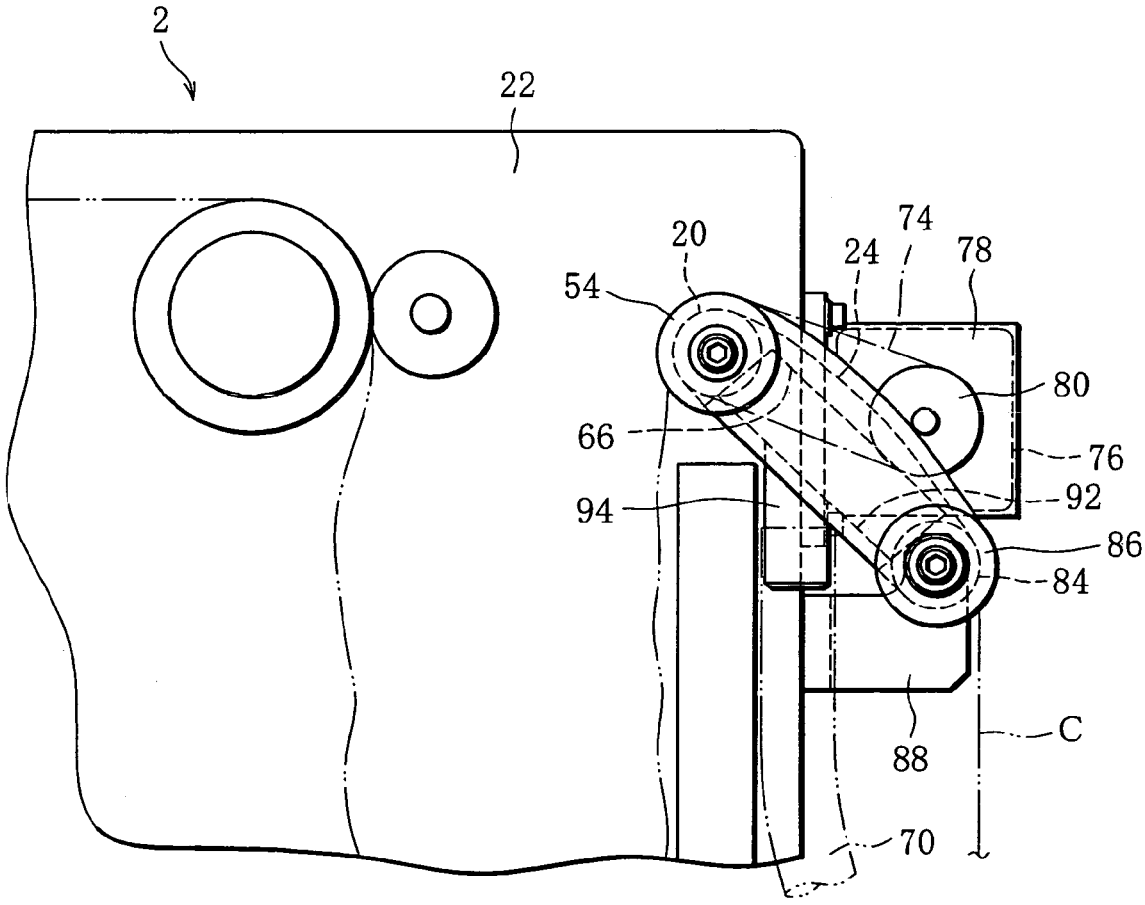
FIG. 4 is an illustration specifically showing how a suction plate, which is different in shape from that in FIG. 2, is fitted.
Figure 5:
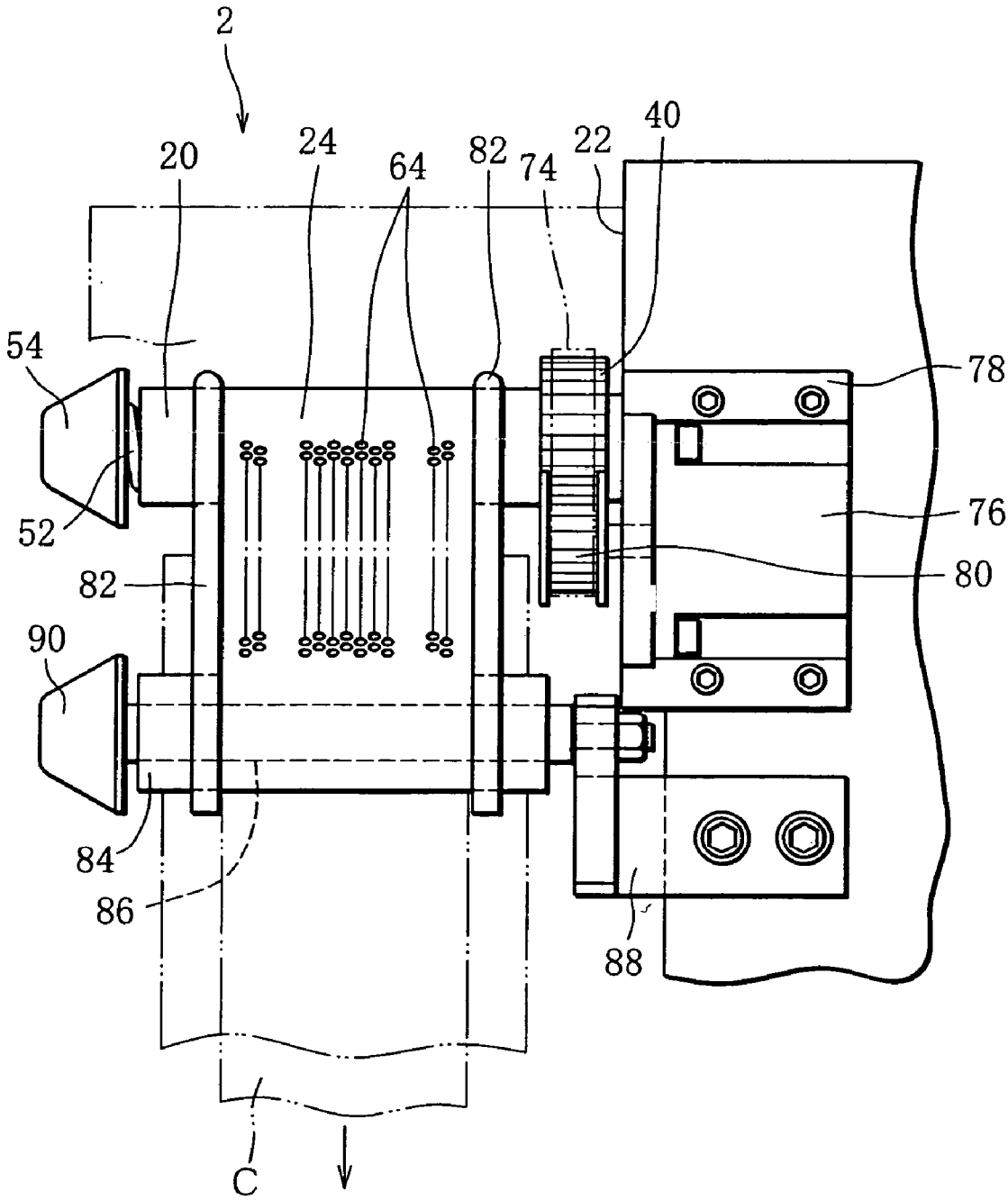
FIG. 5 is a right side view showing how the suction plate is fitted, where

The manner of fitting the suction plate 24 can be modified using the above-described structure of the guide sleeve 20. FIGS. 4 and 5 show another manner of fitting the suction plate 24. In this case, the suction plate 24 extends from the outlet of the reservoir box 2 in the direction in which the tip paper C is drawn out. The suction surface of the suction plate 24 is curved in the direction in which the tip paper C is drawn out. Two guide plates 82 are provided on the opposite sides of the suction plate 24. The two guide plates 82 extend on the opposite sides of the suction plate 24, along the feeding path. The upper edge of each guide plate 82 is shaped into an arc-like 30 shape in accordance with the shape of the suction surface of the suction plate 24. The suction plate 24 and the guide plates 82 are fitted around the guide sleeve 20 at their upper ends and extend downward from the guide sleeve 20, at an angle thereto. An end sleeve 84 is provided at the lower end of the suction plate 24 and guide plates 82, and supports the suction plate 24 and guide plates 82 at their lower ends. The end sleeve 84 is a hollow cylinder, and either end thereof projects beyond the guide plate 82 to the side of the feeding path. A support shaft 86 is passed through the end sleeve 84, and supports the end sleeve 84 in the manner that the end sleeve 84 can slide in the axial direction. At its proximal end, the support shaft 86 is fitted to the body of the reservoir box 2 using a bracket 88. To the distal end of the support shaft 86 is fitted a roller cap 90. As the guide sleeve 20 shifts in the axial direction as described above, the suction plate 24 and the guide plates 82 shift together with the guide sleeve 20, where the support shaft 86 guides the end sleeve 84 in the axial direction.

In this manner of fitting the suction plate, the suction chamber 66 is formed between the guide sleeve 20 and the end sleeve 84. A partition wall 92 forms a bottom of the suction chamber 66. The suction hose 70 is connected to the partition wall 92 with a nozzle 94 between.

Figure 6:
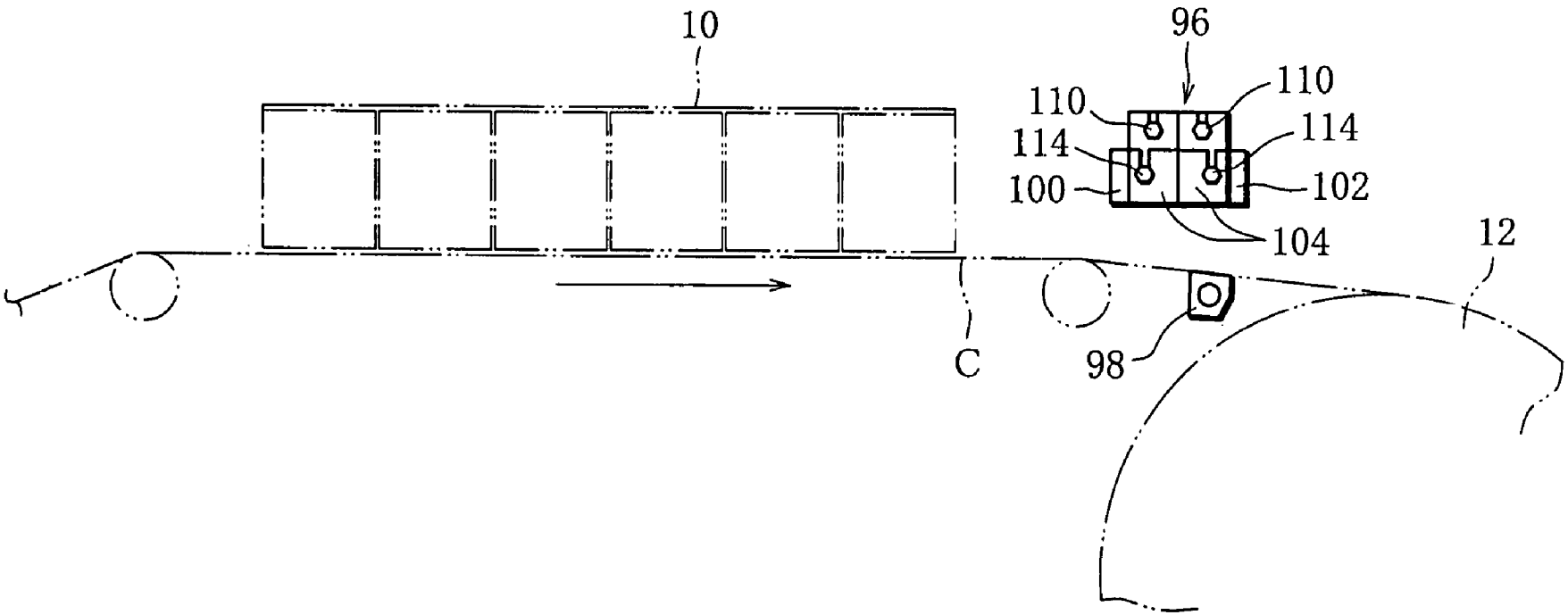
FIG. 6 is an illustration showing how a sensor unit is arranged on a feeding path.
Figure 7:
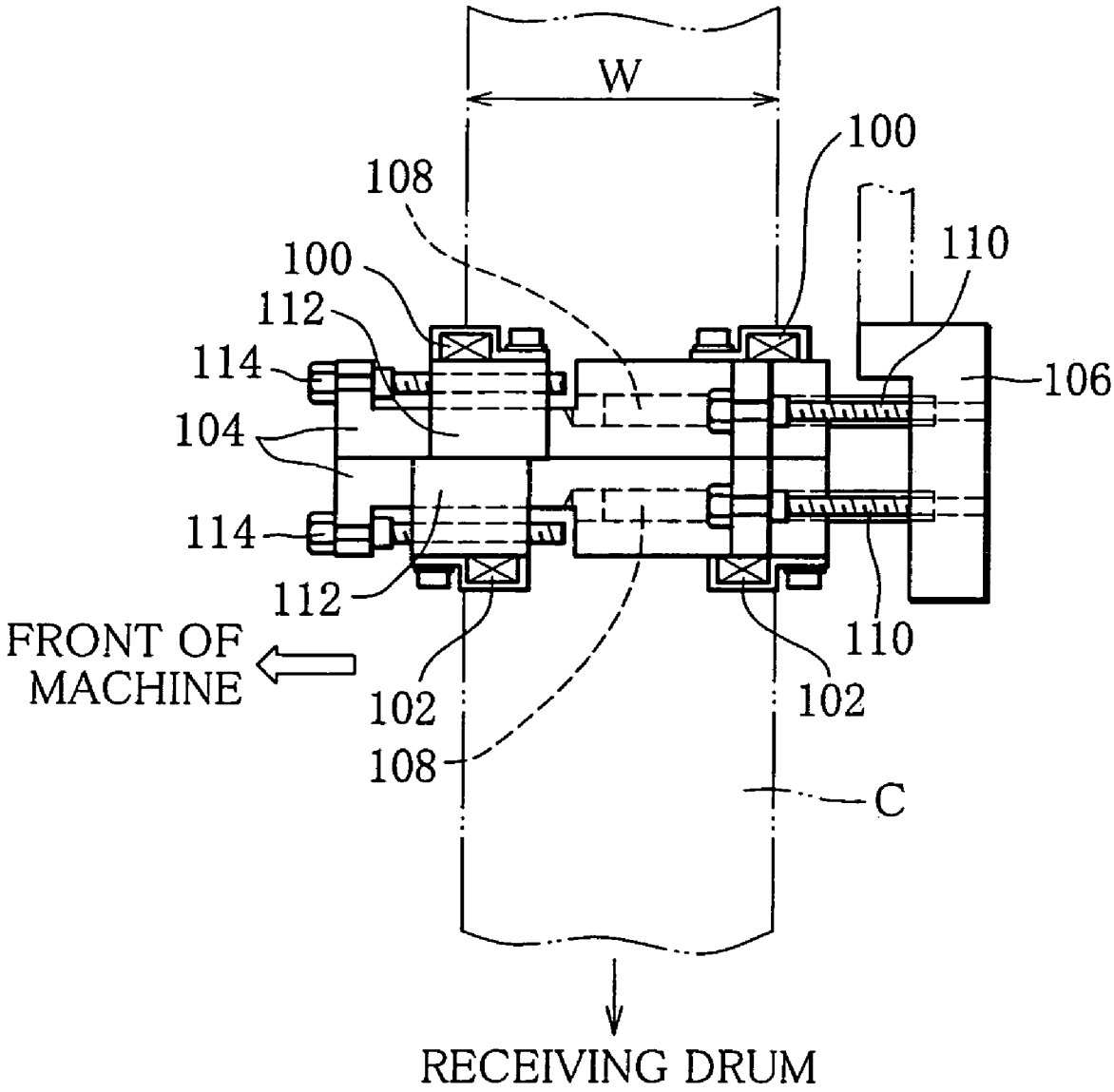
FIG. 7 is a plan view specifically showing the sensor unit of FIG. 6.

FIGS. 6 and 7 specifically show an arrangement of devices for detecting meandering of the tip paper C. On the feeding path, at an upstream side of the receiving drum 12 is provided a sensor unit 96. Right below the sensor unit 96 is located a suction block 98, with the feeding path therebetween. The suction block 98 has many suction holes (not shown) at the surface with which the tip paper C comes in contact, and exerts sucking force on the tip paper C through these suction holes. Unlike the suction plate 24, the suction block 98 is provided in order to keep the tip paper C sucked when the machine is stopped, to thereby prevent the tip paper C from going slack.

As shown in FIG. 7, the sensor unit 96 has two meandering detection sensors 100, 102 on either side of the feeding path. The two meandering detection sensors 100 located upstream on the feeding path are arranged with a distance equal to the width W of the tip paper C between them. The distance between their optical axes of the sensors 100 corresponds to the width W of the tip paper C. The two meandering detection sensors 102 located downstream are each arranged on the inside of the corresponding side edge of the tip paper C. The distance between their optical axes of the sensors 102 is smaller than the width W of the tip paper C.

The sensor unit 96 has two sensor brackets 104 arranged upstream and downstream, respectively, as viewed in the direction in which the tip paper C travels. The sensor brackets 104 are located above the feeding path and extend across the feeding path. The sensor brackets 104 are fitted to the main frame of the filter attachment machine using a common bracket 106. The sensor brackets 140 are each connected to the common bracket 106 by a shaft 108. Each shaft 108, of which the proximal end is fixed in the common bracket 106, projects from the common bracket 106 and extends in the direction across the feeding path. The sensor brackets 104 have each a through-hole adapted to receive the shaft 108. The distal end of each shaft 108 is inserted into the through-hole of the corresponding sensor bracket 104.

An adjust screw 110 is fitted to an upper part of each sensor bracket 104. Each adjust screw 110 extends in the direction across the feeding path with the distal top end of thereof inserted into a screw hole in the common bracket 106. The meandering detection sensors 100, 102 which are located on the back side of the machine are fitted to the side surfaces of their corresponding sensor brackets 104. Thus, the positions of their optical axes of the sensors 100,102 can be adjusted in the direction across the feeding path by using their corresponding adjust screws 110.

The meandering detection sensors 100, 102 which are located on the front side of the machine are fitted to the sensor brackets 104 by means of sensor holders 112. Each sensor holder 112 is supported by its corresponding sensor bracket 104 in the manner that it can slide in the longitudinal direction of the sensor bracket 104. An adjust screw 114 is fitted to the distal end part of each sensor bracket 104. Each adjust screw 114 extends in the direction across the feeding path. A screw hole is formed through each sensor holder 112, and the adjust screws 114 are inserted in to the corresponding screwholes. Thus, also the positions of the optical axes of the meandering detection sensors 100, 102 located on the front side of the machine can be adjusted in the direction across the feeding path by using their corresponding adjust screws 114.

The operation of the motor 76 can be controlled on the basis of detection signals from the meandering detection sensors 100. The control system is schematically shown in FIG. 1. For example, detection signals from the two meandering detection sensors 100 located on the opposite sides of the feeding path are supplied to a controller 120. The controller 120 determines whether the tip paper C meanders or not, on the basis of the detection signals.

Specifically, the normal position of the tip paper C on the feeding path with respect to the width direction of the tip paper C is predetermined. The optical axes of the meandering detection sensors 100 are set on the opposite side edges of the tip paper of the normal potion. If the two meandering detection sensors 100 detect both of the opposite side edges of the tip paper C, the controller 120 determines that the traveling tip paper C is in the normal position. If one of the two meandering detection sensors 100 does not detect one of the opposite side edges of the tip paper C, the controller 120 determines that the traveling tip paper C deviates from the normal position toward the other meandering detection sensor.

When the deviation, or the meandering of the traveling tip paper C is detected, the controller 120 drives the motor 76 to shift the suction plate 24 in the direction across the feeding path. Here, the controller 120 controls the direction of rotation of the motor 76 to shift the suction plate 24 in the direction opposite to the direction in which the tip paper C deviates. As the suction plate 24 is shifted this way, the position of the traveling tip paper C in the width direction thereof is corrected at the downstream side of reservoir box 2, so that the tip paper C is brought back to the normal position.

Here, the controller 120 can feedback-controls the angle of rotation of the motor 76 on the basis of detection signals from the meandering detection sensors 100. For example, the controller 120 takes in detection signals as feedback signals and makes the motor 76 rotate by a predetermined number of steps at a time. When detection signals are supplied from both meandering detection sensors 100, the controller 120 determines that the deviation of the tip paper C has been corrected, and stops the rotation of the motor 76. Since the speed at which the tip paper C travels is sufficiently higher than the speed at which the suction plate 24 shifts, even when the feedback control is performed this way, the suction plate 24 does not shift too much so that the tip paper does not overshoot the normal position. Thus, hunting does not happen in the control system for the motor 76.

As understood from the above, at the downstream side of the reservoir box 2, the tip paper C is strongly pulled lengthwise by the feeding roller 4 and the receiving drum 12. The pulling force exerted on the tip paper C increases to a large degree. Hence, in the area between the reservoir box 2 and the receiving drum 12, it is not easy to shift the tip paper C widthwise. Even if it is intended to correct the meandering of the tip paper C in this area, excessively large force is exerted on the tip paper C. In contrast, inside the reservoir box 2, the tip paper C gets a free state. Thus, it is relatively easy to correct the deviation of the tip paper C near the outlet of the reservoir box 2.

Further, in the present invention, since the meandering of the tip paper C is corrected by shifting the suction plate 24, the tip paper C is shifted widthwise by the sucking-pressure applied to the surface of the tip paper C. Thus, pressing force being concentrated on a side edge of the tip paper C is avoided.

In the embodiment shown in FIGS. 4 and 5, the guide plates 82 are provided on the opposite sides of the suction plate 24. Thus, the holding of the tip paper C by the suction force of the suction plate 24 and the guiding of the tip paper C by the guide plates 82 are attained at the same position on the feeding path. Hence, even when the tip paper C meanders to a very large degree, the tip paper does not deviate from the guide plates 82 to a large degree.

It is to be noted that even when no reservoir box 2 is provided on the feeding path, the suction plate 24 can exert braking force on the tip paper C by itself. Hence, even in the case where no reservoir box is provided depending on the type of a filter attachment machine, the invention can be carried out by providing the suction plate 24. Only, braking force can be exerted more effectively when the suction plate 24 is provided at a place where pulling force exerted on the tip paper C is smaller.

The meandering detection sensors 102 located inside are useful when the tip paper C meanders to a very large degree. Specifically, when the tip paper C deviates to so large a degree that the tip paper C is away from the optical axis of one of the meandering detection sensors 102, filter cigarettes are rejected as defective products at a later step. For this purpose, the controller 120 determines that the filter cigarettes formed while one of the meandering detection sensors 102 does not send out a detection signal should be rejected. At the time filter cigarettes which the controller 120 has determined should be rejected as defective products reaches a rejection drum (not shown), the controller 120 sends out a rejection signal to reject the defective products, for example, by means of an air blow.

While the sensor unit 96 is provided just upstream the receiving drum 12 in the above-described embodiment, it may be provided at another position to detect the meandering of the tip paper C. Also, a plurality of sensor units 96 may be provided at a plurality of positions on the feeding path so that the meandering of the tip paper can be corrected on the basis of their detection.

The above-described manners of fitting the suction plate 24 are all favorable examples. The position at which the suction plate is fitted, the shape of the suction surface and the like may be modified appropriately, depending on the direction in which the tip paper C is drawn out.

In the above-described embodiment, the suction plate 24 is shifted by converting the rotation of the gear pulley 40 to the shift in the axial direction. As another meandering correction means, for example, a ball screw with a ball nut, or a linear actuator may be used. The specific arrangement and structure of the reservoir box 2, the receiving drum 12, the feeding path and the like may be modified depending on the form of an actual filter attachment machine to which the web material feeding apparatus is applied.

The application of the invention is not limited to tip paper. The invention can be broadly applied to feeding apparatuses for various kinds of web materials including paper materials such as a cigarette wrapper, an inner or outer wrapper for a filter rod, and film materials.

The invention claimed is:

1. A web material feeding apparatus, comprising:

a feeding path along which a web material extending from a roll is guided lengthwise, a feeding roller for drawing out and feeding the web material along said feeding path, a suction plate having a flat suction surface arranged to suck the web material planarly being provided on said feeding path, for sucking and thereby exerting braking force on the web material which is drawn out by said feeding roller and traveling, meandering detection means provided at a downstream side of said suction plate on said feeding path, for detecting deviation of the web material with respect to a width direction of the web material, meandering correction means including a guide sleeve provided adjacent to the suction plate to guide the web material in traveling and arranged to be shiftable with the suction plate in the direction parallel to the width of the web material, and shifting means for shifting the guide sleeve in the axial direction thereof for correcting the deviation of the web material by shifting said suction plate in the direction across said feeding path, when the deviation is detected by said meandering detection means, wherein said guide sleeve is mounted on a guide shaft, said guide shaft including a first end with a feed screw disposed thereon for selectively imparting a shift in an axial direction to said guide sleeve, and a gear pulley operatively connected to said feed screw and in engagement with said guide sleeve for cooperating with said feed screw to impart the shift in the axial direction to said guide sleeve.

2. The web material feeding apparatus according to claim 1, further comprising a reservoir box provided on said feeding path, for storing the web material drawn out from said roll, wherein said suction plate is provided near an outlet of said reservoir box.

3. The web material feeding apparatus according to claim 1, further comprising two guide members provided near said suction plate on the opposite sides of said feeding path, for guiding the opposite side-edges of the web material, wherein said meandering correction means is adapted to shift said two guide members together with said suction plate.

4. The web material feeding apparatus according to claim 1, further comprising a reservoir box provided on said feeding path, for storing the web material drawn out from said roll, and two guide members provided near said suction plate on the opposite sides of said feeding path, for guiding the opposite side-edges of the web material, wherein said suction plate is provided near an outlet of said reservoir box, and said meandering correction means is adapted to shift said two guide members together with said suction plate.

5. The web material feeding apparatus according to claim 1, and further including a flange operatively connected to said guide sleeve and a thrust bearing surface formed on said gear pulley for receiving the flange of the guide sleeve for supporting the guide sleeve in the axial direction.

6. The web material feeding apparatus according to claim 1, and further including a bracket operatively connected to said suction plate, said bracket being attached to said guide sleeve for being shifted in the axial direction together with said guide sleeve.

* * * * *